US008933283B2

(12) United States Patent
Kim et al.

(10) Patent No.: US 8,933,283 B2
(45) Date of Patent: Jan. 13, 2015

(54) PROCESS FOR THE PREPARATION OF CLEAN FUEL AND AROMATICS FROM HYDROCARBON MIXTURES CATALYTIC CRACKED ON FLUID BED

(75) Inventors: Cheol Joong Kim, Daejeon (KR); Jae Wook Ryu, Daejeon (KR); Kyeong Hak Seong, Daejeon (KR); Byoung Mu Chang, Daejeon (KR); Byeung Soo Lim, Daejeon (KR); Jong Hyung Lee, Daejeon (KR); Kyung Seok Noh, Uijeongbu-si (KR); Hyuck Jae Lee, Daejeon (KR); Sam Ryong Park, Daejeon (KR); Sun Choi, Daejeon (KR); Seung Hoon Oh, Seoul (KR); Yong Seung Kim, Daejeon (KR); Gyung Rok Kim, Daejeon (KR)

(73) Assignee: SK Innovation Co., Ltd., Seoul (KR)

( * ) Notice: Subject to any disclaimer, the term of this patent is extended or adjusted under 35 U.S.C. 154(b) by 208 days.

(21) Appl. No.: 13/130,590

(22) PCT Filed: Nov. 26, 2008

(86) PCT No.: PCT/KR2008/006974

§ 371 (c)(1),
(2), (4) Date: Aug. 15, 2011

(87) PCT Pub. No.: WO2010/061986

PCT Pub. Date: Jun. 3, 2010

(65) Prior Publication Data

US 2011/0288354 A1 Nov. 24, 2011

(51) Int. Cl.
*C07C 4/00* (2006.01)
*C07C 4/02* (2006.01)

(Continued)

(52) U.S. Cl.
CPC ..... *C10G 65/16* (2013.01); *C10G 65/00* (2013.01); *C10G 65/12* (2013.01); *C10G 69/00* (2013.01);

(Continued)

(58) Field of Classification Search
USPC ..... 585/304, 319, 324, 475, 489, 833; 208/111.1, 111.35, 137, 138, 106–108
See application file for complete search history.

(56) References Cited

U.S. PATENT DOCUMENTS 3,175,966 A * 3/1965 Burch ..... 208/79
4,234,750 A * 11/1980 Mikulicz ..... 585/332

(Continued)

FOREIGN PATENT DOCUMENTS

JP 2003-516465 5/2003
KR 10-2008-0645659 11/2006

(Continued)

OTHER PUBLICATIONS

Singapore Search Report mailed Jul. 3, 2012 for Singapore Application No. 201103724-9.

(Continued)

*Primary Examiner* — Bobby Ramdhanie
*Assistant Examiner* — Philip Louie
(74) *Attorney, Agent, or Firm* — Richard M. Klein; Fay Sharpe LLP

(57) ABSTRACT

This invention relates to a petroleum refining method for producing high value-added clean petroleum products and aromatics (Benzene/Toluene/Xylene) together, by which low pollution petroleum products including liquefied petroleum gas or low-sulfur gas oil and aromatics can be efficiently produced together from a fluid catalytic cracked oil fraction.

10 Claims, 5 Drawing Sheets

(51) Int. Cl.

| | |
|---|---|
| ***C07C 15/04*** | (2006.01) |
| ***C07C 15/06*** | (2006.01) |
| ***C07C 15/08*** | (2006.01) |
| ***C10L 3/12*** | (2006.01) |
| ***C10G 65/16*** | (2006.01) |
| ***C10G 65/00*** | (2006.01) |
| ***C10G 65/12*** | (2006.01) |
| ***C10G 69/00*** | (2006.01) |
| ***C10G 69/04*** | (2006.01) |

(52) U.S. Cl.

CPC ..... *C10G 69/04* (2013.01); *C10G 2400/30* (2013.01); *C10G 2300/202* (2013.01); *C10G 2400/26* (2013.01); *C10G 2400/28* (2013.01)

USPC ..... 585/304; 585/319; 585/324; 585/475; 585/489; 208/111.1; 208/111.35; 208/137; 208/138

(56) References Cited

U.S. PATENT DOCUMENTS

| | | | | |
|---|---|---|---|---|
| 4,324,646 | A * | 4/1982 | Le Page et al. | 208/71 |
| 4,990,239 | A | 2/1991 | Derr, Jr. et al. | |
| 5,009,768 | A | 4/1991 | Galiasso et al. | |
| 5,685,972 | A * | 11/1997 | Timken et al. | 208/89 |
| 6,406,615 | B1 * | 6/2002 | Iwamoto et al. | 208/213 |
| 6,635,792 | B2 * | 10/2003 | Choi et al. | 585/489 |
| 7,304,195 | B2 * | 12/2007 | Choi et al. | 585/489 |
| 2004/0140244 | A1 * | 7/2004 | Sughrue et al. | 208/15 |
| 2004/0211704 | A1 * | 10/2004 | Espeillac et al. | 208/106 |
| 2006/0000751 | A1 * | 1/2006 | Bouchy et al. | 208/217 |
| 2006/0260983 | A1 * | 11/2006 | Iki et al. | 208/213 |

FOREIGN PATENT DOCUMENTS

| | | | |
|---|---|---|---|
| WO | WO-2006/137615 | | 12/2006 |
| WO | WO-2006/137616 | | 12/2006 |
| WO | WO 2006137616 | A1 * | 12/2006 |
| WO | WO 2007/135769 | | 11/2007 |

OTHER PUBLICATIONS

International Search Report dated Jul. 29, 2009 in PCT/KR2008/006974.

Petrochemistry, Oil refining process, Japan, May 20, 1998, pp. 209-213 & 309-311 (we do not have an English translation of this document).

David S. J. "Stan" Jones et al., "Handbook of Petroleum Processing", p. 360, Chapter 9, Springer, 2006.

James G. Speight, "Handbook of Petroleum Product Analysis", pp. 6-8 and 39-41, John Wiley & Sons, Inc., 2002.

Extended European Search Report for corresponding European Application No. 08878449.1 dated May 12, 2014.

* cited by examiner

PROCESS FOR THE PREPARATION OF CLEAN FUEL AND AROMATICS FROM HYDROCARBON MIXTURES CATALYTIC CRACKED ON FLUID BED

TECHNICAL FIELD

The present invention relates to a method of producing high value-added clean petroleum products and aromatics from a fluid catalytic cracked oil fraction, and more particularly, to a method of producing low pollution petroleum products including liquefied petroleum gas (LPG) or low-sulfur gas oil and aromatics (Benzene/Toluene/Xylene), by passing a fluid catalytic cracked oil fraction through a distillation unit, a hydrodesulfurization/hydrodenitrogenation unit, and a hydrocracking/dealkylation unit.

BACKGROUND ART

Techniques for efficiently producing petrochemical products and intermediate products thereof from a fluid catalytic cracked oil fraction are widely known to be (1) subjecting fluid catalytic cracked gasoline to catalytic reforming thus preparing reformate which is then separated, thereby producing aromatics, (2) subjecting fluid catalytic cracked gas oil to hydrodesulfurization thus preparing low-sulfur gas oil products, and (3) subjecting fluid catalytic cracked gas oil to hydrocracking thus preparing low-sulfur gas oil, LPG and naphtha.

However, the technique (1) is limitedly applied to the fluid catalytic cracked gasoline, in particular, only a middle boiling point gasoline fraction having a low octane number, and is unable to produce LPG and low-sulfur gas oil, the demand for which is increasing.

Although the technique (2) may advantageously correspond to the demand for low-sulfur gas oil resulting from hydrodesulfurization of the fluid catalytic cracked gas oil which may be used alone or in combination with light gas oil produced through atmospheric distillation of crude oil, it cannot be applied to an increase in the demand for LPG and aromatics.

The technique (3) is advantageous because it may correspond to an increase in the demand for low-sulfur gas oil having a high cetane number and LPG and may be used to produce naphtha the demand for which is continuously increasing. However, with this technique it is not easy to control severe conditions of operation, and thus it cannot be easily adapted to stepwise enhancement of standard of gas oil products, the consumption of hydrogen is much greater compared to the technique (2), and also it is incapable of producing aromatics.

DISCLOSURE

Technical Problem

Accordingly, the present invention provides a novel method which enables the efficient preparation of low pollution petroleum products including LPG and low-sulfur gas oil and aromatics from a fluid catalytic cracked oil fraction.

In addition, the present invention provides a method of increasing the efficiency of an alkylation unit which is a satellite process of an upstream fluid catalytic cracking unit using LPG obtained through the above method.

In addition, the present invention provides a method of increasing the entire process efficiency by efficiently producing hydrogen necessary for hydrogenation using fuel gas which is by-produced through the above method.

Technical Solution

According to the present invention, a method of preparing low pollution petroleum products and aromatics from a fluid catalytic cracked oil fraction includes (a) distilling a fluid catalytic cracked oil fraction, thus separating the fluid catalytic cracked oil fraction into effluent oil and residual oil; (b) subjecting the effluent oil obtained in (a) to hydrodesulfurization/hydrodenitrogenation, thus removing sulfur and nitrogen compounds from the effluent oil; (c) subjecting an aromatic hydrocarbon compound in the effluent oil subjected to hydrodesulfurization/hydrodenitrogenation, to dealkylation, thus converting the aromatic hydrocarbon compound into an aromatic hydrocarbon mixture in which benzene, toluene and xylene are enriched, and subjecting a non-aromatic hydrocarbon compound therein to hydrocracking, thus converting the non-aromatic hydrocarbon compound into an LPG-enriched non-aromatic hydrocarbon mixture; (d) separately recovering fuel gas, LPG and aromatics from the aromatic hydrocarbon mixture and the LPG-enriched non-aromatic hydrocarbon mixture obtained in (c); and (e) subjecting the residual oil obtained in (a) to hydrodesulfurization/hydrodenitrogenation, thus obtaining low-sulfur gas oil.

Advantageous Effects

According to the present invention, LPG, low-sulfur gas oil and aromatics can be efficiently produced together from a fluid catalytic cracked oil fraction containing almost no aromatics and LPG, and the yield of each product can be adjusted through control of severe conditions of operation.

Further, a C4 oil fraction obtained according to the present invention can be supplied as a feedstock for an alkylation unit which is a satellite process of a fluid catalytic cracking unit, thus improving the entire fluid catalytic cracking efficiency, and also a fuel gas which is by-produced can be used as a feedstock for a hydrogen unit, thereby maximizing the improvement efficiency thereof.

DESCRIPTION OF THE REFERENCE NUMERALS IN THE DRAWINGS

Figure 1:
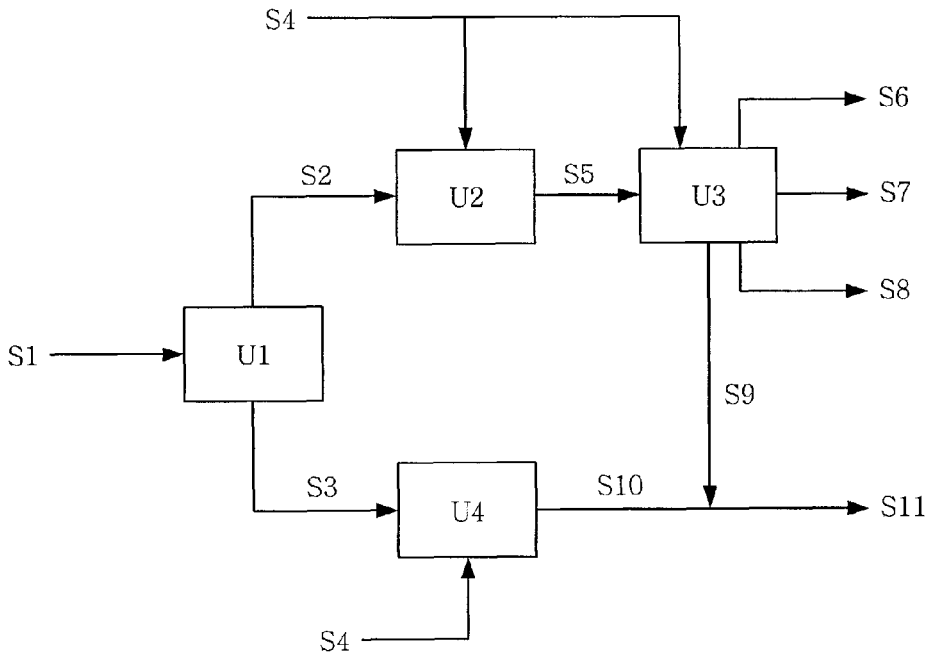
FIG. 1 is a schematic view showing the process according to an embodiment of the present invention.

U1, U21: distillation unit
U2, U4, U20: hydrodesulfurization/hydrodenitrogenation unit
U3, U22: hydrocracking/dealkylation unit
U30: fluid catalytic cracking unit
U31: alkylation unit
U40: hydrogen unit

BEST MODE

According to the present invention, a method of preparing low pollution petroleum products and aromatics from a fluid catalytic cracked oil fraction includes (a) distilling a fluid catalytic cracked oil fraction, thus separating it into effluent oil and residual oil, (b) subjecting the effluent oil obtained in (a) to hydrodesulfurization/hydrodenitrogenation, thus removing sulfur and nitrogen compounds from the effluent oil, (c) subjecting an aromatic hydrocarbon compound in the effluent oil subjected to hydrodesulfurization/hydrodenitrogenation, to dealkylation, thus converting the above compound into an aromatic hydrocarbon mixture in which benzene, toluene and xylene are enriched, and subjecting a non-aromatic hydrocarbon compound therein to hydrocracking, thus converting the above compound into a LPG-enriched non-aromatic hydrocarbon mixture, (d) separately recovering fuel gas, LPG and aromatics from the aromatic hydrocarbon mixture and the LPG-enriched non-aromatic hydrocarbon mixture obtained in (c), and (e) subjecting the residual oil obtained in (a) to hydrodesulfurization/hydrodenitrogenation, thus obtaining low-sulfur gas oil.

The above method may further include introducing at least part of the fuel gas recovered in (d) into a hydrogen unit, thus preparing hydrogen, which is then circulated to (b), (c) and (e).

Also, the above method may further include supplying at least part of C4 paraffinic hydrocarbon in the LPG recovered in (d) as a feedstock for an alkylation unit which is a satellite process of an upstream fluid catalytic cracking unit.

Useful in (c), a catalyst may be prepared by mixing 10~95 wt % of zeolite, which is at least one selected from the group consisting of mordenite, beta type zeolite and ZSM-5 type zeolite and has a molar ratio of silica/alumina of 200 or less, with 5~90 wt % of an inorganic binder, thus obtaining a mixture support, which is then impregnated with platinum/tin or platinum/lead.

In addition, according to another embodiment of the present invention, a method of preparing low pollution petroleum products and aromatics from a fluid catalytic cracked oil fraction includes (a) subjecting a fluid catalytic cracked oil fraction to hydrodesulfurization/hydrodenitrogenation, thus removing sulfur and nitrogen compounds from the oil fraction, (b) distilling the oil fraction subjected to hydrodesulfurization/hydrodenitrogenation in (a), thus separating the oil fraction into effluent oil and residual oil, (c) subjecting an aromatic hydrocarbon compound in the effluent oil to dealkylation, thus converting the above compound into an aromatic hydrocarbon mixture in which benzene, toluene and xylene are enriched, and subjecting a non-aromatic hydrocarbon compound therein to hydrocracking, thus converting the above compound into a LPG-enriched non-aromatic hydrocarbon mixture, (d) separately recovering fuel gas, LPG and aromatics from the aromatic hydrocarbon mixture and the LPG-enriched non-aromatic hydrocarbon mixture obtained in (c), and (e) recovering the residual oil obtained in (b) as low-sulfur gas oil.

The above method may further include introducing at least part of the fuel gas recovered in (d) to a hydrogen unit, thus preparing hydrogen which is then circulated to (a) and (c).

Also, the above method may further include supplying at least part of C4 paraffinic hydrocarbon in the LPG recovered in (d) as a feedstock for an alkylation unit which is a satellite process of an upstream fluid catalytic cracking unit.

Useful in (c), a catalyst may be prepared by mixing 10~95 wt % of zeolite which is at least one selected from the group consisting of mordenite, beta type zeolite and ZSM-5 type zeolite and has a molar ratio of silica/alumina of 200 or less with 5~90 wt % of an inorganic binder, thus obtaining a mixture support, which is then impregnated with platinum/tin or platinum/lead.

The fluid catalytic cracked oil fraction used in the present invention may be hydrocarbon mixtures having a boiling point range of 170~360° C. According to the present invention, the fluid catalytic cracked oil fraction containing less than 2 mass % aromatics (BTX) including benzene, toluene and xylene and having no LPG may be efficiently prepared into not only 15 mass % or more aromatics and 12 mass % or more LPG but also low-sulfur gas oil, and the production yield of each product may be adjusted depending on the necessary throughput.

In the present invention, a distillation unit is used to separate the fluid catalytic cracked oil fraction serving as a feedstock into a light oil fraction and a heavy oil fraction depending on the difference in the boiling point, in which the light oil fraction is utilized to produce fuel gas, LPG and aromatics, and the heavy oil fraction is employed to attain low-sulfur gas oil. The light oil fraction is composed of hydrocarbons having a boiling point of 170~220° C., and the heavy oil fraction is composed of hydrocarbons having a boiling point of 220~360° C.

In the present invention, a hydrodesulfurization/hydrodenitrogenation unit is used to remove sulfur and nitrogen compounds which are impurities contained in the oil fraction, in order to produce low pollution hydrocarbon fuel in which generation of SOx and NOx is very low and to maintain the activity of a catalyst for use in a downstream hydrocracking/dealkylation unit. This unit is operated in a manner such that the oil fraction is reacted with hydrogen in the presence of the catalyst for hydrogenation.

The catalyst for hydrogenation is exemplified by any catalyst which is typically known for hydrodesulfurization/hydrodenitrogenation. Particularly useful is a catalyst in which NiMo or CoMo is supported on alumina.

In the present invention, the hydrodesulfurization/hydrodenitrogenation unit may be operated under conditions of hydrogen partial pressure of 10~50 kg/cm$^2$, hydrogen amount of 50~400 Nm$^3$/kl, LHSV of 0.1~10 hr$^{-1}$, and reaction temperature of 200~400° C. These conditions are adequate for hydrotreating the fed oil fraction to thus remove impurities such as sulfur or nitrogen. In the case where the severity of the above conditions is increased so that part of the oil fraction is hydrocracked, a naphtha component may be further included in a final product.

In the method according to the present invention, the hydrodesulfurization/hydrodenitrogenation unit may be located downstream or upstream of the distillation unit. In the case where the hydrodesulfurization/hydrodenitrogenation unit is located downstream of the distillation unit, the effluent oil obtained by distilling the fluid catalytic cracked oil fraction is subjected to hydrodesulfurization/hydrodenitrogenation. Alternatively, in the case where the hydrodesulfurization/hydrodenitrogenation unit is located upstream of the distillation unit, the fluid catalytic cracked oil fraction may be directly subjected to hydrodesulfurization/hydrodenitrogenation, and then separated into the light oil fraction and the heavy oil fraction.

In the former case, the light oil fraction and the heavy oil fraction are respectively subjected to hydrodesulfurization/hydrodenitrogenation. Whereas, in the latter case, the whole oil fraction is subjected to hydrodesulfurization/hydrodenitrogenation and then separated, thus advantageously achieving a desired purpose through a simpler construction compared to the former case.

In the present invention, a hydrocracking/dealkylation unit is used to react the highly refined oil fraction obtained from the upstream hydrodesulfurization/hydrodenitrogenation unit with hydrogen in the presence of the catalyst, thereby obtaining fuel gas, LPG and aromatics.

The catalyst used therein may be prepared by mixing 10~95 wt % of zeolite which is at least one selected from the group consisting of mordenite, beta type zeolite and ZSM-5 type zeolite and has a molar ratio of silica/alumina of 200 or less with 5~90 wt % of an inorganic binder, thus preparing a mixture support, which is then implemented with 0.01~0.5 parts by weight of platinum based on the total weight of the mixture support and then with tin or lead. As such, tin may be supported in an amount of 0.1~5.0 parts by weight, or lead may be supported in an amount of 0.02~5.0 parts by weight.

The catalyst causes dealkylation, transalkylation and hydrocracking of the feedstock in at least one reactor within the reaction zone.

In the present invention, the oil fraction containing aromatic and non-aromatic components through hydrodesulfurization/hydrodenitrogenation is introduced into the hydrocracking/dealkylation unit at WHSV of 0.5~10 $hr^{-1}$, and thus allowed to react under conditions of temperature of 250~600° C. and pressure of 5~50 atm.

In the hydrocracking/dealkylation unit, dealkylation of the aromatic component and the hydrocracking of the non-aromatic component occur under the above reaction conditions in the presence of the catalyst, thereby obtaining fuel gas, LPG, and aromatics including benzene, toluene and xylene.

On the other hand, an unconverted oil fraction resulting from the hydrocracking/dealkylation may be mixed with the heavy oil fraction of the fluid catalytic cracked oil fraction passed through the hydrodesulfurization/hydrodenitrogenation unit and thus may be produced in the form of low-sulfur gas oil.

Below, the present invention is described in more detail with reference to the appended drawings.

Figure 2:
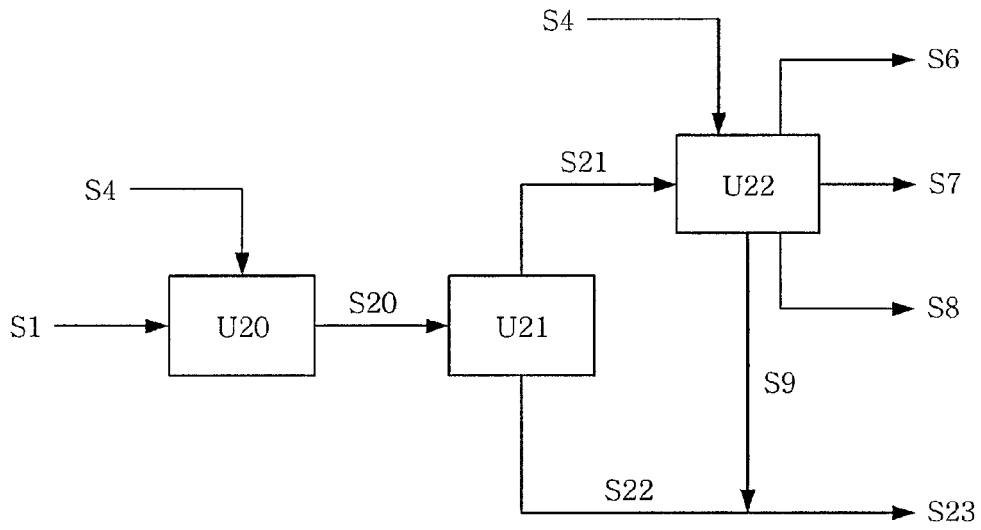
FIG. 2 is a schematic view showing the process according to another embodiment of the present invention.

FIGS. 1 and 2 schematically illustrate the process of preparing LPG, low-sulfur gas oil and aromatics together from the fluid catalytic cracked oil fraction according to embodiments of the present invention.

As shown in FIG. 1, a fluid catalytic cracked oil fraction S1 is introduced into a distillation unit U1, so that a light oil fraction is separated in the form of effluent oil S2 and a heavy oil fraction is separated in the form of residual oil S3.

The effluent oil S2 is introduced into a hydrodesulfurization/hydrodenitrogenation unit U2 to allow it to react with hydrogen S4 in the presence of a catalyst, thus removing sulfur and nitrogen compounds which poison the catalyst, after which the treated oil fraction S5 is supplied into a downstream hydrocracking/dealkylation unit U3 to allow it to react with hydrogen S4 in the presence of a catalyst, and thus converted into fuel gas S6, LPG S7, aromatics S8 and an unconverted oil fraction S9.

On the other hand, the residual oil S3 separated through the distillation unit U1 is supplied into an additional hydrodesulfurization/hydrodenitrogenation unit U4 to allow it to react with hydrogen S4 in the presence of a catalyst, thus preparing low-sulfur gas oil S10 having a low sulfur content. Further, the low-sulfur gas oil S10 may be mixed with at least part of the unconverted oil fraction S9 produced through the hydrocracking/dealkylation unit U3, resulting in low-sulfur gas oil S11.

As shown in FIG. 2, a fluid catalytic cracked oil fraction S1 is introduced into a hydrodesulfurization/hydrodenitrogenation unit U20 to allow it to react with hydrogen S4 in the presence of a catalyst, thus preparing an oil fraction S20 in which large amounts of sulfur and nitrogen compounds are removed. The oil fraction S20 is supplied into a distillation unit U21, so that a light oil fraction is separated in the form of effluent oil S21, and a heavy oil fraction is separated in the form of residual oil S22. The operation conditions of the hydrodesulfurization/hydrodenitrogenation unit U20 may be adjusted such that the amounts of sulfur and nitrogen compounds contained in the effluent oil S21 from the distillation unit U21 fall within an allowable limit for a catalyst for use in a downstream hydrocracking/dealkylation unit U22.

In the hydrocracking/dealkylation unit U22, the effluent oil S21 is allowed to react with hydrogen S4 in the presence of the catalyst, and thus converted into fuel gas S6, LPG S7, aromatics S8 and an unconverted oil fraction S9.

On the other hand, the residual oil S22 separated through the distillation unit U21 may be mixed with at least part of the unconverted oil fraction S9 produced through the hydrocracking/dealkylation unit U22, thus preparing low-sulfur gas oil S23.

Figure 3:
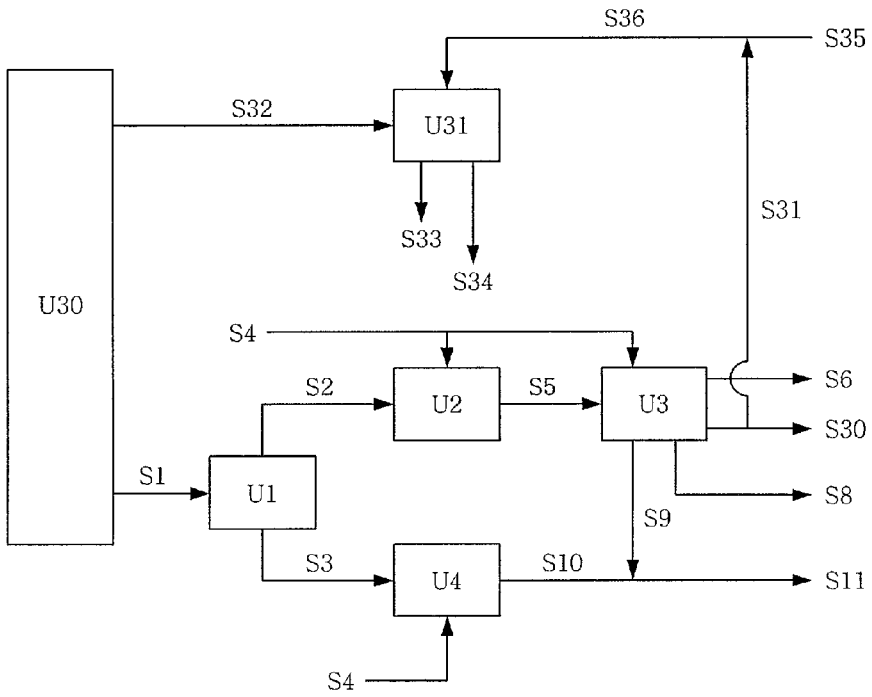
FIG. 3 is a schematic view showing the process according to a further embodiment of the present invention.

FIG. 3 illustrates the process which further includes supplying butane produced using the process according to the present invention as a feedstock for an alkylation unit is a satellite process of the fluid catalytic cracking unit.

Part of butane S31 which is C4 component in the LPG produced through the method of the present invention may be mixed with a general butane mixture S35, and thus supplied as a feedstock S36 of an alkylation unit U31, and only propane S30 which is C3 component may be separated and recovered. The alkylation unit U31 also receives a C3/C4 olefin-rich stream S32 from the fluid catalytic cracking unit U30.

In the present invention, because butane produced through the hydrocracking/dealkylation unit U3 has a ratio of iso-butane to n-butane higher than that of the general butane mixture S35, it may be supplied as a feedstock for the alkylation unit U31 which is typically adopted as a satellite process of the fluid catalytic cracking unit U30, thereby increasing the efficiency of the alkylation unit U31. That is, in the case where iso-butane is contained in the feedstock for the alkylation unit in an amount larger than that of n-butane which does not participate in the alkylation reaction, the scale of an apparatus necessary for separation of n-butane S34 and alkylate S33 may be minimized, thereby improving the efficiency of the alkylation unit U31.

Figure 4:
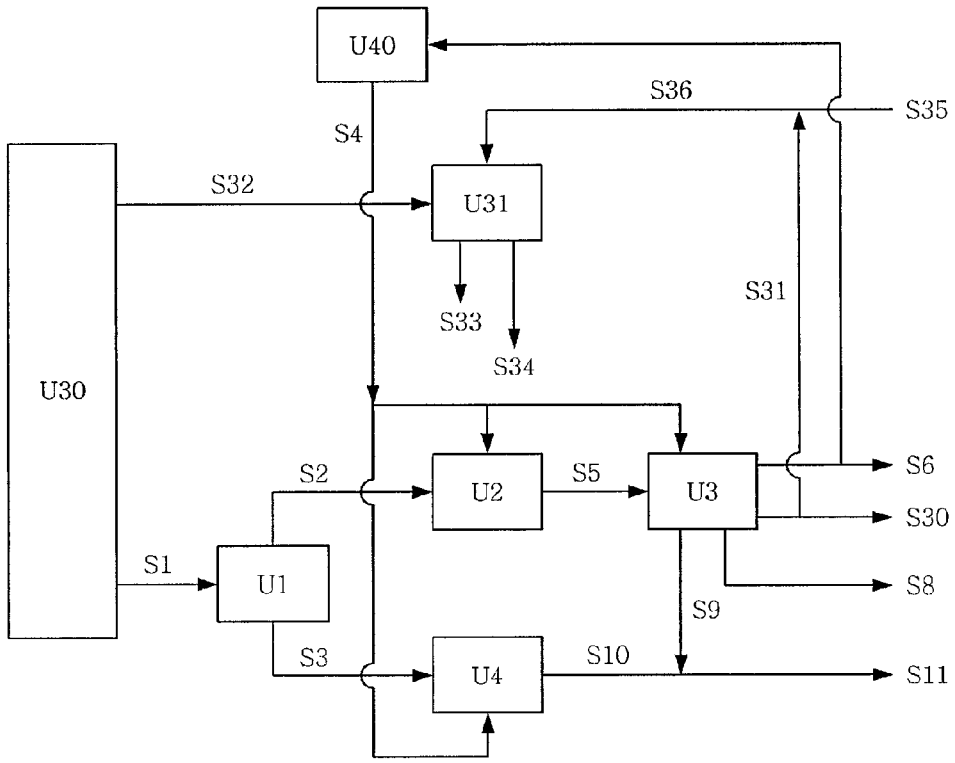
FIG. 4 is a schematic view showing the process according to still a further embodiment of the present invention.

FIG. 4 illustrates the process which further includes using part of fuel gas S6 obtained according to the present invention as a feedstock for a hydrogen unit U40 and supplying hydrogen S4 prepared through the hydrogen unit U40 into the hydrodesulfurization/hydrodenitrogenation units U2, U4 and the hydrocracking/dealkylation unit U3.

In the method according to the present invention, the fuel gas S6 which is converted and separated through the hydrocracking/dealkylation unit U3 is composed of methane, ethane and the like, having a relatively lower carbon number, and thus used as a feedstock for the hydrogen unit U40 to supply hydrogen necessary for the hydrodesulfurization/hydrodenitrogenation and hydrocracking/dealkylation. The fuel gas S6 produced by the method of the present invention has almost no olefin and hydrogen sulfide. So, in the hydrogen unit U40, pretreatment for removal of sulfur compounds may be omitted, and accordingly the plant investment cost may be reduced.

FIGS. 3 and 4 are based on the case where the distillation unit U1 is located upstream of the hydrodesulfurization/hydrodenitrogenation units U2, U4 as shown in FIG. 1, but may be equivalently applied even to the case of performing distillation following hydrodesulfurization/hydrodenitrogenation as shown in FIG. 2.

MODE FOR INVENTION

A better understanding of the present invention may be obtained through the following examples, which are set forth to illustrate, but are not to be construed to limit the present invention.

EXAMPLE 1

As is apparent from Table 1 below, a fluid catalytic cracked oil fraction having a boiling point of 160~300° C. serving as a feedstock was distilled under atmospheric conditions, thus obtaining two kinds of oil fractions having a boiling point of 160~220° C. and a boiling point of 220~300° C.

Depending on the type of feedstock for the fluid catalytic cracking unit and the operation conditions thereof, the properties, composition and yield of the resulting fluid catalytic cracked oil fraction may vary, but the claims of the present invention are not limited thereto.

TABLE 1

| | Feedstock | Effluent Oil | Residual Oil |
|---|---|---|---|
| Sp. Gr. (15/4° C.) | 0.8953 | 0.8427 | 0.9297 |
| Sulfur, wt ppm | 1,800 | 330 | 2,700 |
| Nitrogen, wt ppm | 400 | 220 | 500 |
| Aromatics, wt % | 75 | 65 | 80 |
| Distillation, D-86, ° C. | | | |
| IBP | 132 | 127 | 231 |
| 5% | 186 | 162 | 242 |
| 10% | 194 | 169 | 246 |
| 30% | 214 | 181 | 251 |
| 50% | 234 | 189 | 261 |
| 70% | 259 | 195 | 277 |
| 90% | 294 | 203 | 303 |
| 95% | 309 | 207 | 314 |
| EP | 319 | 212 | 321 |

EXAMPLE 2

The effluent oil of Table 1 of Example 1 was subjected to hydrodesulfurization/hydrodenitrogenation in the presence of a catalyst. In the presence of any one selected from the group consisting of commercial available desulfurization catalysts, hydrogen was added into a high-pressure fix-bed reactor so that hydrodesulfurization/hydrodenitrogenation was performed. The reaction conditions and results thereof are shown in Table 2 below. Depending on the type of commercial available desulfurization catalyst, the reaction conditions and the properties of reaction product may slightly vary but the claims of the present invention are not limited thereto.

TABLE 2

| Type of Catalyst/Amount | $NiMo/Al_2O_3$/55 cc | |
|---|---|---|
| Operation Conditions | | |
| Hydrogen Partial Pressure, $kg/cm^2$ | 30 | |
| Gas/Oil, $Nm^3/kl$ | 300 | |
| LHSV, $hr^{-1}$ | 1.2 | |
| Reaction Temp., ° C. | 290 | 300 |
| Reaction Product Result | | |
| Sulfur, wt ppm | <1 | <1 |
| Nitrogen, wt ppm | <1 | <1 |
| Aromatics, wt % | 59.3 | 58.7 |

EXAMPLE 3

The reaction product of Example 2 was subjected to hydrocracking/dealkylation, thus preparing LPG and aromatics.

A mixture support composed of mordenite having a molar ratio of silica/alumina of 20 and γ-alumina as a binder was mixed with $H_2PtCl_6$ aqueous solution and $SnCl_2$ aqueous solution such that the amount of mordenite in the support with the exception of platinum and tin was 75 wt %. Platinum and tin were respectively supported in amounts of 0.05 parts by weight and 0.5 parts by weight based on total 100 parts by weight of the mixture support. The mixture support thus obtained was molded to have a diameter of 1.5 mm and a length of 10 mm, dried at 200° C. for 12 hours, and then burned at 500° C. for 4 hours, thus preparing a catalyst. The reaction was performed using a fix-bed reactor under conditions (370° C., 30 $kg/cm^2$, $H_2$/HC 5.3, WHSV 1.0 $hr^{-1}$). The representative yields are shown in Table 3 below.

TABLE 3

| Yield (wt %) | Ex. 3 |
|---|---|
| H2 | −2.68 |
| C1 + C2 | 14.35 |
| C3 | 29.37 |
| C4 | 6.72 |
| C5 + Non-Aromatics | 3.81 |
| Benzene | 4.81 |
| Toluene | 13.38 |
| Ethylbenzene | 0.52 |
| Xylene | 13.29 |
| C9 + Aromatics | 16.43 |

EXAMPLE 4

Figure 5:
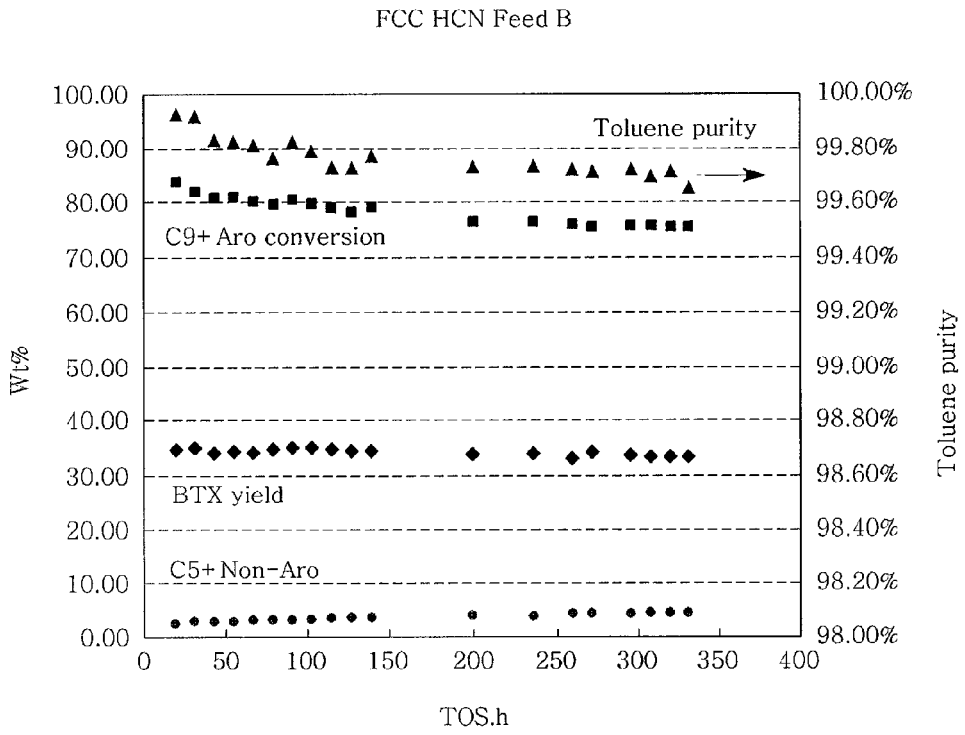
FIG. 5 is a graph showing the change in yield of each product versus time when producing LPG, low-sulfur gas oil, and aromatics through the process according to the present invention.

In addition to Example 3, using the fix-bed reactor, the reaction was continuously performed for 330 hours or longer under conditions (370° C., 30 $kg/cm^2$, $H_2$/HC 5.3, WHSV 1.0 $hr^{-1}$). Even after a lapse of the reaction time, the yields were confirmed to be stably maintained. The change in yield depending on the reaction time is depicted in FIG. 5.

EXAMPLE 5

The residual oil of Table 1 of Example 1 was subjected to hydrodesulfurization/hydrodenitrogenation in the presence of a catalyst. In the presence of any one selected from the group consisting of commercial available desulfurization catalysts, hydrogen was added into a high-pressure fix-bed reactor so that hydrodesulfurization/hydrodenitrogenation was performed. The reaction conditions and results thereof are shown in Table 4 below. Depending on the type of commercial available desulfurization catalyst, the reaction conditions and the properties of reaction product may slightly vary but the claims of the present invention are not limited thereto.

TABLE 4

| Type of Catalyst/Amount | $CoMo/Al_2O_3$/100 cc | |
|---|---|---|
| Operation Conditions | | |
| Hydrogen Partial Pressure, $kg/cm^2$ | 32 | |
| Gas/Oil, $Nm^3/kl$ | 100 | |
| LHSV, $hr^{-1}$ | 3.5 | |
| Reaction Temp., ° C. | 320 | 330 |
| Reaction Product Result | | |
| Sulfur, wt ppm | 66 | 46 |
| Nitrogen, wt ppm | 81 | 57 |

EXAMPLE 6

The feedstock of Table 1 of Example 1 was subjected to hydrodesulfurization/hydrodenitrogenation in the presence of a catalyst. Using a combination of two catalysts selected from the group consisting of commercial available desulfurization catalysts, hydrogen was added into a high-pressure fix-bed reactor so that hydrodesulfurization/hydrodenitrogenation was performed. The reaction conditions and results thereof are shown in Table 5 below. Depending on the type of commercial available desulfurization catalyst, the reaction conditions and the properties of the reaction product may slightly vary, but the claims of the present invention are not limited thereto.

TABLE 5

| Type of Catalyst/Amount | $CoMo/Al_2O_3NiMo/Al_2O_3$/55 cc |
|---|---|
| Operation Conditions | |
| Hydrogen Partial Pressure, kg/cm$^2$ | 42 |
| Gas/Oil, Nm$^3$/kl | 220 |
| LHSV, hr$^{-1}$ | 0.72 |
| Reaction Temp., ° C. | 330 |
| Reaction Product Result | |
| Sulfur, wt ppm | 6 |
| Nitrogen, wt ppm | <1 |
| Aromatics, wt % | 69 |

EXAMPLE 7

In the fluid catalytic cracked oil fraction subjected to hydrodesulfurization/hydrodenitrogenation in the presence of hydrogen and catalyst as in Example 6, an oil fraction feedstock having a boiling point range of 160~300° C. as seen in Table 6 below was distilled under atmospheric conditions, thus preparing an oil fraction having a boiling point of 160~220° C. and another oil fraction having a boiling point of 220~300° C.

Depending on the type of fluid catalytic cracking feedstock and the operation conditions, the properties, composition and yield of the resulting fluid catalytic cracked oil fraction may vary, but the claims of the present invention are not limited thereto.

TABLE 6

| | Feedstock | Effluent Oil | Residual Oil |
|---|---|---|---|
| Sulfur, wt ppm | 6 | <1 | 10.7 |
| Nitrogen, wt ppm | <1 | <1 | <1 |
| Aromatics, wt % | 69 | 68.1 | 69.3 |

EXAMPLE 8

The reaction product of Example 7 was subjected to hydrocracking/dealkylation, thus preparing LPG and aromatics.

A catalyst was prepared in the same manner as in Example 3, and the reaction was performed using a fix-bed reactor under conditions (370° C., 30 kg/cm$^2$, $H_2$/HC 5.3, WHSV 1.0 hr$^{-1}$). The representative yields are shown in Table 7 below.

TABLE 7

| Yield (wt %) | Ex. 8 |
|---|---|
| H2 | −2.44 |
| C1 + C2 | 13.92 |
| C3 | 27.62 |
| C4 | 6.55 |
| C5 + Non-Aromatics | 3.40 |
| Benzene | 5.17 |
| Toluene | 14.01 |
| Ethylbenzene | 0.54 |
| Xylene | 14.12 |
| C9 + Aromatics | 17.11 |

The invention claimed is:

1. A process for preparing liquefied petroleum gas, low-sulfur gas oil, benzene, toluene, and xylene from a fluid catalytic cracked oil fraction, comprising:

(a) separating a fluid catalytic cracked oil fraction having a boiling point range of from 160° C. to 360° C. into an effluent oil fraction having a boiling point range of from 160° C. to 220° C. and a residual oil fraction having a boiling point range of from 220° C. to 360° C. by distillation, the fluid catalytic cracked oil fraction containing less than 2 mass % of benzene, toluene and xylene and being substantially free of liquefied petroleum gas;

(b) subjecting the effluent oil fraction to hydrodesulfurization/hydrodenitrogenation to remove sulfur and nitrogen compounds therein;

(c) subjecting the effluent oil fraction from step (b) to hydrocracking and dealkylation/transalkylation in the presence of a catalyst comprising (I) a support mixture of 10 to 95 wt % of at least one zeolite selected from the group consisting of mordenite, beta type zeolite and ZSM-5 type zeolite, the zeolite having a molar ratio of silica/alumina of 200 or less, and 5 to 90 wt % of an inorganic binder, and (II) a metal component consisting of (i) 0.01 to 0.5 parts by weight of platinum and (ii) 0.1 to 5.0 parts by weight of tin or 0.02 to 5.0 parts by weight of lead, based on the total weight of the mixture support, to convert aromatic hydrocarbon compounds in the effluent oil fraction into an aromatic hydrocarbon mixture enriched in benzene, toluene and xylene and to convert non-aromatic hydrocarbon compounds in the effluent oil fraction into a liquefied petroleum gas-enriched non-aromatic hydrocarbon mixture containing fuel gas;

(d) separating the effluent oil fraction from step (c) into a converted oil fraction and a unconverted oil fraction, and separately recovering fuel gas, liquefied petroleum gas and an aromatic mixture of benzene, toluene and xylene from the converted oil fraction; and (e) subjecting the residual oil fraction of step (a) to hydrodesulfurization/hydrodenitrogenation, followed by mixing at least a part of the unconverted oil fraction therewith, and recovering the resulting mixture of oil fractions as low-sulfur gas oil;

wherein the hydrodesulfurization/hydrodenitrogenation in each of steps (b) and (e) is carried out under conditions of hydrogen partial pressure of 10 to 50 kg/cm$^2$, hydrogen amount of 50 to 400 Nm$^3$/kl, LHSV of 0.1 to 10 hr$^{-1}$, and reaction temperature of 200 to 400° C., wherein the effluent oil fraction from step (c) contains benzene, toluene and xylene in an amount of 15 mass % or more, and liquefied petroleum gas of 12 mass % or more, wherein no petroleum fraction other than the fluid catalytic cracked oil fraction is supplied to the process, and wherein no separation of the effluent oil fraction is carried out between steps (b) and (c).

2. A process for preparing liquefied petroleum gas, low-sulfur gas oil, benzene, toluene, and xylene from a fluid catalytic cracked oil fraction, comprising:

(a) subjecting a fluid catalytic cracked oil fraction having a boiling point range of from 160° C. to 360° C. to hydrodesulfurization/hydrodenitrogenation to remove sulfur and nitrogen compounds therein under conditions of hydrogen partial pressure of 10 to 50 $kg/cm^2$, hydrogen amount of 50 to 400 $Nm^3/kl$, LHSV of 0.1 to 10 $hr^{-1}$, and reaction temperature of 200 to 400° C., the fluid catalytic cracked oil fraction containing less than 2 mass % of benzene, toluene and xylene and being substantially free of liquefied petroleum gas;

(b) separating the fluid catalytic cracked oil fraction from step (a) into an effluent oil fraction having a boiling point range of from 160° C. to 220° C. and a residual oil fraction having a boiling point range of from 220° C. to 360° C. by distillation;

(c) subjecting the effluent oil fraction to hydrocracking and dealkylation/transalkylation in the presence of a catalyst comprising (I) a support mixture of 10 to 95 wt % of at least one zeolite selected from the group consisting of mordenite, beta type zeolite and ZSM-5 type zeolite, the zeolite having a molar ratio of silica/alumina of 200 or less, and 5 to 90 wt % of an inorganic binder, and (II) a metal component consisting of (i) 0.01 to 0.5 parts by weight of platinum and (ii) 0.1 to 5.0 parts by weight of tin or 0.02 to 5.0 parts by weight of lead, based on the total weight of the mixture support, to convert aromatic hydrocarbon compounds in the effluent oil fraction into an aromatic hydrocarbon mixture enriched in benzene, toluene and xylene and to convert non-aromatic hydrocarbon compounds in the effluent oil fraction into a liquefied petroleum gas-enriched non-aromatic hydrocarbon mixture containing fuel gas;

(d) separating the effluent oil fraction from step (c) into a converted oil fraction and a unconverted oil fraction, and separately recovering fuel gas, liquefied petroleum gas and an aromatic mixture of benzene, toluene and xylene from the converted oil fraction; and (e) mixing at least a part of the unconverted oil fraction with the residual oil fraction from step (b) and recovering the resulting mixture of oil fractions as low-sulfur gas oil;

wherein the effluent oil fraction from step (c) contains benzene, toluene and xylene in an amount of 15 mass % or more, and liquefied petroleum gas of 12 mass % or more, wherein no petroleum fraction other than the fluid catalytic cracked oil fraction is supplied to the process, and wherein no separation of the effluent oil fraction is carried out between steps (b) and (c).

3. The process according to claim 1, wherein the recovered liquefied petroleum gas is subjected to separation to obtain butanes, and said butanes are supplied directly to an alkylation unit for preparing alkylate, and the butanes contain isobutane in a larger amount than n-butane.

4. The process according to claim 1, wherein all or part of the recovered fuel gas from step (d) is supplied to a hydrogen unit for producing hydrogen used for the hydrodesulfurization/hydrodenitrogenation and the hydrocracking and dealkylation/transalkylation.

5. The process according to claim 2, wherein the recovered liquefied petroleum gas is subjected to separation to obtain butanes, and said butanes are supplied directly to an alkylation unit for preparing alkylate, and the butanes contain isobutane in a larger amount than n-butane.

6. The process according to claim 2, wherein all or part of the recovered fuel gas from step (d) is supplied to a hydrogen unit for producing hydrogen used for the hydrodesulfurization/hydrodenitrogenation and the hydrocracking and dealkylation/transalkylation.

7. The process according to claim 3, wherein all or part of the recovered fuel gas from step (d) is supplied to a hydrogen unit for producing hydrogen used for the hydrodesulfurization/hydrodenitrogenation and the hydrocracking and dealkylation/transalkylation.

8. The process according to claim 5, wherein all or part of the recovered fuel gas from step (d) is supplied to a hydrogen unit for producing hydrogen used for the hydrodesulfurization/hydrodenitrogenation and the hydrocracking and dealkylation/transalkylation.

9. The process according to claim 1, wherein the hydrocracking and dealkylation/transalkylation is carried out under conditions of WHSV of 0.5 to 10 $hr^{-1}$, a reaction temperature of 250° C. to 600° C., and a reaction pressure of 5 to 50 atm.

10. The process according to claim 2, wherein the hydrocracking and dealkylation/transalkylation is carried out under conditions of WHSV of 0.5 to 10 $hr^{-1}$, a reaction temperature of 250° C. to 600° C., and a reaction pressure of 5 to 50 atm.

* * * * *